US008713802B2

(12) United States Patent
Fukutani et al.

(10) Patent No.: US 8,713,802 B2
(45) Date of Patent: May 6, 2014

(54) HAIR-CLIPPER

(75) Inventors: Makoto Fukutani, Hikone (JP); Toshio Ikuta, Hikone (JP); Jiro Inaba, Nagahama (JP)

(73) Assignee: Panasonic Corporation, Osaka (JP)

( * ) Notice: Subject to any disclaimer, the term of this patent is extended or adjusted under 35 U.S.C. 154(b) by 923 days.

(21) Appl. No.: 12/195,728

(22) Filed: Aug. 21, 2008

(65) Prior Publication Data

US 2009/0056143 A1 Mar. 5, 2009

(30) Foreign Application Priority Data

Aug. 28, 2007 (JP) ..... 2007-220675

(51) Int. Cl.
*B26B 19/06* (2006.01)

(52) U.S. Cl.
USPC ..... 30/208; 30/209; 30/233.5; 30/346.51

(58) Field of Classification Search
USPC ..... 30/32–541; 451/83, 162
See application file for complete search history.

(56) References Cited

U.S. PATENT DOCUMENTS

| | | | | |
|---|---|---|---|---|
| 2,641,833 | A | 6/1953 | Need | |
| 3,032,875 | A | 5/1962 | Gwynne | |
| 3,100,342 | A | 8/1963 | Reiner | |
| 3,279,056 | A * | 10/1966 | Andis | 30/34.1 |
| 3,436,822 | A | 4/1969 | Heyek | |
| 3,986,258 | A * | 10/1976 | Liedtke | 30/30 |
| 5,367,772 | A * | 11/1994 | Ogawa | 30/201 |
| 6,079,103 | A * | 6/2000 | Melton et al. | 30/43.92 |
| 6,901,664 | B2 * | 6/2005 | Melton et al. | 30/210 |
| 7,918,029 | B2 * | 4/2011 | Melton et al. | 30/233.5 |
| 2003/0145469 | A1 | 8/2003 | Ogawa et al. | |
| 2004/0200077 | A1 * | 10/2004 | Liao et al. | 30/346.51 |
| 2006/0156549 | A1 | 7/2006 | O | |
| 2006/0265879 | A1 | 11/2006 | Sagawa et al. | |
| 2007/0044320 | A1 | 3/2007 | Fukutani et al. | |
| 2007/0107234 | A1 | 5/2007 | Yao | |
| 2007/0261249 | A1 | 11/2007 | Yamasaki et al. | |
| 2007/0289144 | A1 | 12/2007 | Morisugi et al. | |
| 2009/0144988 | A1 * | 6/2009 | Lau | 30/208 |
| 2009/0320296 | A1 * | 12/2009 | Morisugi et al. | 30/43.92 |
| 2011/0061243 | A1 * | 3/2011 | Smit | 30/233.5 |
| 2011/0173818 | A1 * | 7/2011 | Lacov et al. | 30/223 |

FOREIGN PATENT DOCUMENTS

| | | |
|---|---|---|
| DE | 126789 | 11/2000 |
| EP | 1449627 | 8/2004 |
| EP | 1454720 | 9/2004 |
| FR | 643305 | 9/1928 |

(Continued)

OTHER PUBLICATIONS

English language Abstract of JP 53-061470.

(Continued)

*Primary Examiner* — Omar Flores Sanchez
(74) *Attorney, Agent, or Firm* — Greenblum & Bernstein P.L.C.

(57) ABSTRACT

A hair-clipper includes a stationary blade and a movable blade. The comb projections of the stationary blade include a skin-contact surface which abuts against skin, and a slide surface with which the comb projections of the movable blade come into slide contact. Further, the main body of the stationary blade includes an opposed surface which is opposed to a plane including the skin-contact surface, and a shortest distance between the opposed surface and the plane including the skin-contact surface is equal to or greater than a distance between the plane including the skin-contact surface and the comb projection of the movable blade.

3 Claims, 7 Drawing Sheets

(56) References Cited

FOREIGN PATENT DOCUMENTS

| | | |
|---|---|---|
| GB | 781014 | 8/1957 |
| JP | 35-012880 | 9/1960 |
| JP | 35-12880 | 9/1960 |
| JP | 38-14816 | 7/1963 |
| JP | 52-171468 | 12/1977 |
| JP | 53-20674 | 2/1978 |
| JP | 53-061470 | 6/1978 |
| JP | 53-61470 | 6/1978 |
| JP | 53-89551 | 8/1978 |
| JP | 53-089551 | 8/1978 |
| JP | 2-92389 | 4/1990 |
| RU | 859144 | 8/1981 |

OTHER PUBLICATIONS

Partial English language translation of JP 52-171468.
Partial English language translation of JP 35-012880.
English language Abstract of JP 53-089551.
English language Abstract of JP 38-14816, Jul. 19, 1963.
Korea Office action, mail date is Sep. 30, 2010 and English translation.

* cited by examiner

HAIR-CLIPPER

CROSS REFERENCE TO RELATED APPLICATIONS

This application is based upon and claims the benefit of priority from prior Japanese Patent Application P2007-220675 filed on Aug. 28, 2007; the entire contents of which are incorporated by reference herein.

BACKGROUND OF THE INVENTION

The present invention relates to a hair-clipper that reciprocates a movable blade with respect to a stationary blade to cut hair.

Conventionally, there is a hair-clipper that includes a stationary blade and a movable blade having a plurality of comb projections having blades formed at their both sides. The hair-clipper is moved forward in a projecting direction of the comb projections and hair is introduced between the comb projections of the stationary blade and the movable blade, the movable blade is reciprocated with respect to the stationary blade in an arrangement direction of the comb projections to cut the hair.

As the hair-clipper of this kind, Japanese Utility Model Application Laid-open No. S38-14816 discloses a known hair-clipper in which a hair escape route is formed in a lower surface behind the comb projections provided on a tip end of the stationary blade, hair that is cut when the hair-clipper is moved forward is introduced into the hair escape route, a friction force generated between the lower surface of the stationary blade and a head that comes into contact with the lower surface when the hair-clipper is moved forward is reduced, thereby enhancing the operability of the hair-clipper.

SUMMARY OF THE INVENTION

According to the conventional technique, however, since the blade portions of the comb projections of the stationary blade are formed on the upper surface of the stationary blade and the position of the upper portion of the hair escape route is located at a position lower than the blade portion of the comb projection of the stationary blade, when the hair-clipper is moved forward, hair introduced into the hair escape route abuts against the surface having the hole and the hair is pushed down. Thus, hair before it is cut is pushed down by the pushed down hair, the former hair is cut in a state where the hair is longer than a cutting height, and there is an adverse possibility that the cutting heights of hair become uneven.

Therefore, an object of the present invention is to provide a hair-clipper capable of evenly set the cut height of hair.

A first aspect of the present invention provides a hair-clipper comprising a stationary blade having a main body provided with a plurality of comb projections having blades formed at their both sides, and a movable blade that has a main body having a plurality of comb projections having blades formed at their both sides and that comes into slide contact with the stationary blade, in which the movable blade is reciprocated and slid in an arrangement direction of the comb projections with respect to the stationary blade to cut hair, wherein the comb projections of the stationary blade include a skin-contact surface which abuts against a skin, and a slide surface with which the comb projections of the movable blade come into slide contact, the main body of the stationary blade includes an opposed surface which is opposed to a plane including the skin-contact surface, and a shortest distance between the opposed surface and the plane including the skin-contact surface is equal to or greater than a distance between the plane including the skin-contact surface and the comb projection of the movable blade.

DETAILED DESCRIPTION OF THE PREFERRED EMBODIMENTS

Embodiments of the present invention will be explained below in detail with reference to the accompanying drawings.

First Embodiment

Figure 1A:
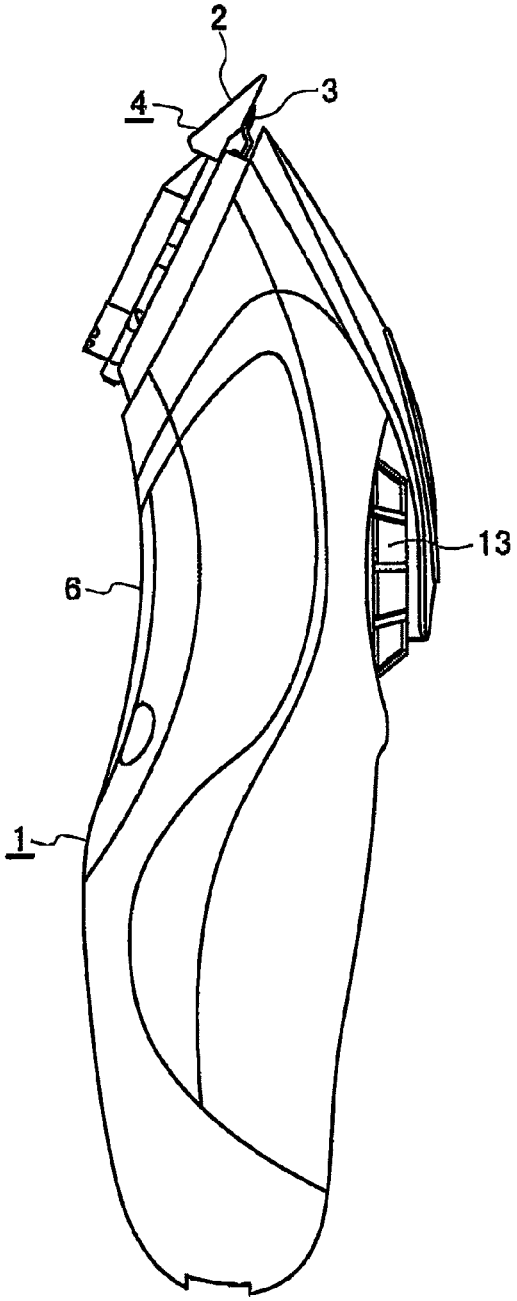
FIG. 1A is a front view showing a hair-clipper according to a first embodiment of the present invention.
Figure 1B:
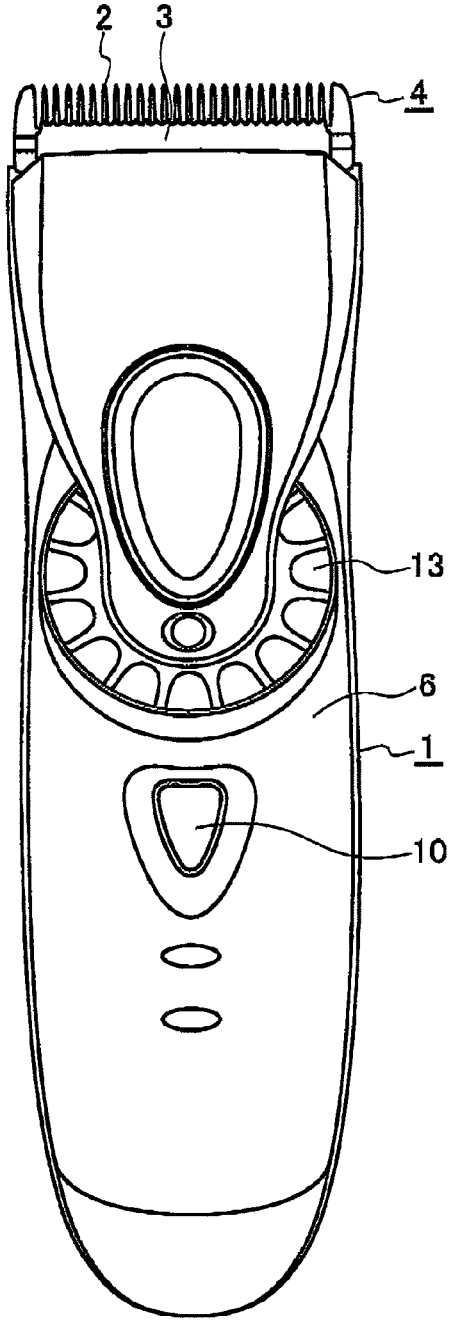
FIG. 1B is a side view showing the hair-clipper according to the first embodiment.

In a hair-clipper according to a first embodiment of the present invention, as shown in FIGS. 1A and 1B, a blade block 4 having a stationary blade 2 and a movable blade 3 is mounted on one end of a thin and long main body 1 in its longitudinal direction (upper end in FIGS. 1A and 1B). The main body 1 also functions as a grip. The movable blade 3 of the blade block 4 is reciprocated in a short-hand direction (lateral direction in FIG. 1B) of the main body 1 with respect to the stationary blade 2 using the motor 5 placed in the main body 1 as a driving source, and hair introduced into the blade grooves 23 on the tip end of the stationary blade 2 is nipped between the movable blade 3 and cut.

Figure 2:
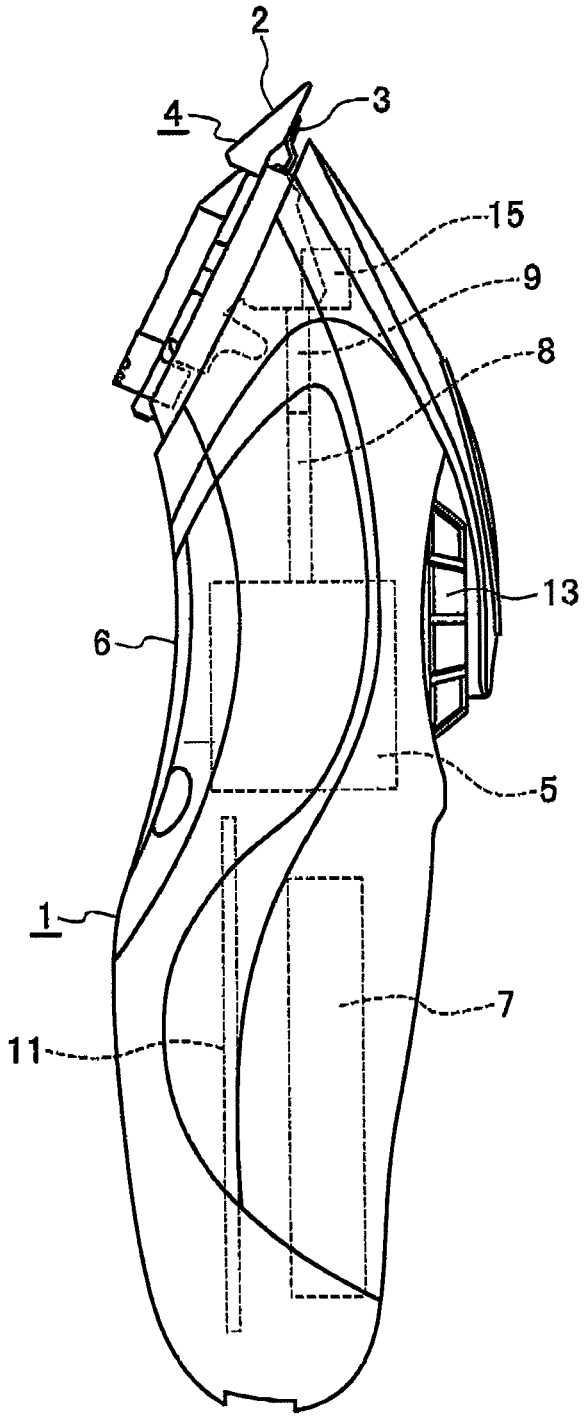
FIG. 2 is a perspective side view of main parts in the hair-clipper body according to the first embodiment.

As shown in FIG. 2, the main body 1 includes, in a main body housing 6 that can be grasped by one hand and that forms an S-shaped outer shell as viewed from side, a charged battery 7, a motor 5 to which electricity is supplied from the charged battery 7 and which is rotated and driven, a power transmitting mechanism 8 which transmits a rotation driving force of the motor 5 to one end of the main body 1 in its longitudinal direction, an eccentric shaft 9 that is eccentrically rotated by the power transmitting mechanism 8, and a control unit 11 that controls the electricity supply to the motor 5 in accordance with pressing operation of an operation switch 10 that is exposed outside.

The eccentric shaft 9 projects from the main body housing 6 toward the blade block 4 (upward in FIGS. 1A, 1B, and 2) such as to be connected to a later-described guide plate 17 provided in the blade block 4. A dial 13 for adjusting the cutting height is turnably placed on an outer surface of the main body housing 6 on the side of the blade block 4 (upward in FIGS. 1A, 1B, and 2) of the operation switch 10, and a transmitting mechanism 15 that tilts a later-described switching lever 19 provided in the blade block 4 in association with normal and reverse rotation of the dial 13 is provided in the main body housing 6.

The blade block 4 includes a comb teeth-like stationary blade 2 having a main body 21 that includes a plurality of tapered comb projections 22 having blades formed at their both sides, and a comb teeth-like movable blade 3 that includes a main body 21 having a plurality of tapered comb projections 32 having blades formed at its both sides, and that slides on the stationary blade 2.

The comb projections 32 that are in slide contact with the upper surface (slide surface 22*b*) of the comb projections 22 are reciprocated and slid in a direction (X direction) in which the comb projections 22 and 32 are arranged with respect to the stationary blade 2, thereby cutting hair introduced between the blades of the comb projection 22 and the comb projection 32.

Further, in the first embodiment, the blade block 4 includes a fixing plate 16 that is fixed to rear portions in the projecting direction (Y direction) of the comb projections 22 and 32 of the stationary blade 2 by a hook (not shown) for engaging the main body 21 of the stationary blade 2, the guide plate 17 that has a hook 17*a* for engaging the main body 31 of the movable blade 3 and that fixes the hook 17*a* and the movable blade 3 by heat seal, a coil spring 18 placed between the fixing plate 16 and the guide plate 17 in a state where the spring 18 is elastically deformed such as to give a biasing force for pushing the movable blade 3 toward the stationary blade 2, and the switching lever 19 that has a columnar portion 19*a* pivotally provided in a semi-circular groove 16*b* formed in the fixing plate 16. The switching lever 19 is placed on the fixing plate 16 such that it can tilt around the columnar portion 19*a*. A coil portion of the spring 18 is fitted into the switching lever 19 such that the switching lever 19 is biased in a falling posture by the spring 18.

When the switching lever 19 is turned toward its standing posture against the biasing force of the spring 18, the movable blade 3 slid forward in the projecting direction (Y direction) of the comb projections 22 and 32 in a state where the movable blade 3 keeps the pushing state against the stationary blade 2 through the spring 18 and the guide plate 17.

In the first embodiment, an operating member provided on the transmitting mechanism 15 is slid forward in the projecting direction (Y direction) of the comb projections 22 (having cutting surfaces 22*s*) and 32 (having cutting surfaces 32*s*) to push a projection portion 19*b* provided on the switching lever 19, thereby turning the switching lever 19 to its standing posture.

More specifically, when a rotation position of the dial 13 is moved to a predetermined positive direction, the operation member is slid forward in the projecting direction (Y direction) of the comb projections 22 and 32 through the transmitting mechanism 15, and the switching lever 19 is turned toward the standing posture against the biasing force of the spring 18. With this, the movable blade 3 slides forward in the projecting direction (Y direction) of the comb projections 22 and 32 such that a tip end of the comb projection 32 approaches the tip end of the comb projection 22 of the stationary blade 2. When the rotation position of the dial 13 is moved in the opposite direction, the operating member is slid rearward in the projecting direction (Y direction) of the comb projections 22 and 32 through the transmitting mechanism 15, the switching lever 19 is turned toward the falling posture by the biasing force of the spring 18, and the movable blade 3 is slid rearward in the projecting direction (Y direction) of the comb projections 22 and 32 such that a tip end of the comb projection 32 is separated from the tip end of the comb projection 22 of the stationary blade 2.

At this time, since the comb projection 22 of the stationary blade 2 is formed into a tapered shape as viewed from side such that its thickness t is varied along the projecting direction (Y direction), when the sliding position of the movable blade 3 with respect to the stationary blade 2 is changed as described above, it is possible to adjust the cutting height of hair.

Figure 5:
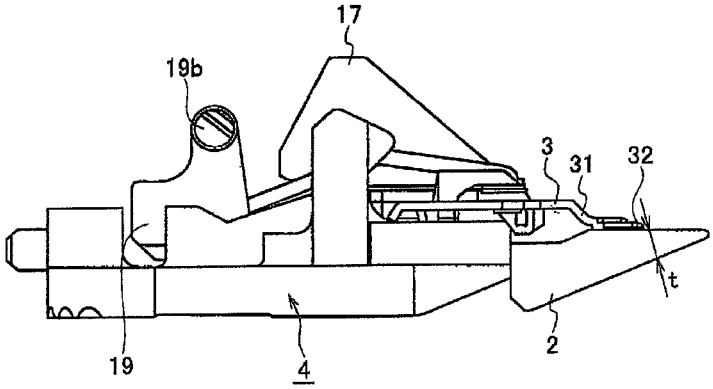
FIG. 5 is a side view of the blade block of the hair-clipper according to the first embodiment.
Figure 6:
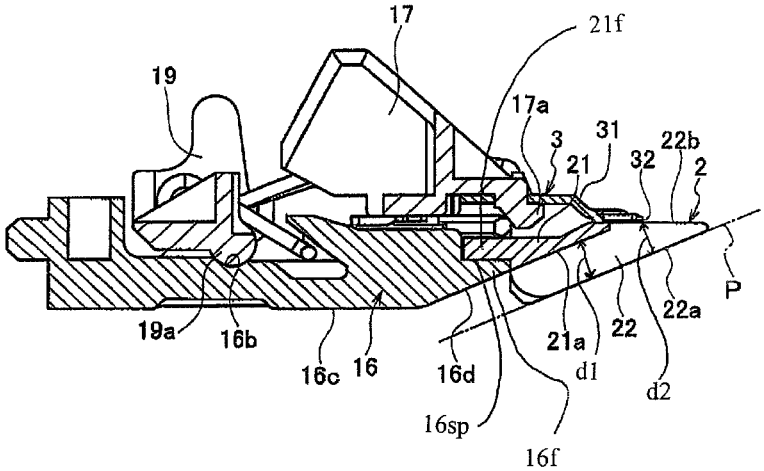
FIG. 6 is a sectional view taken along the line VI-VI in FIG. 4.
Figure 7:
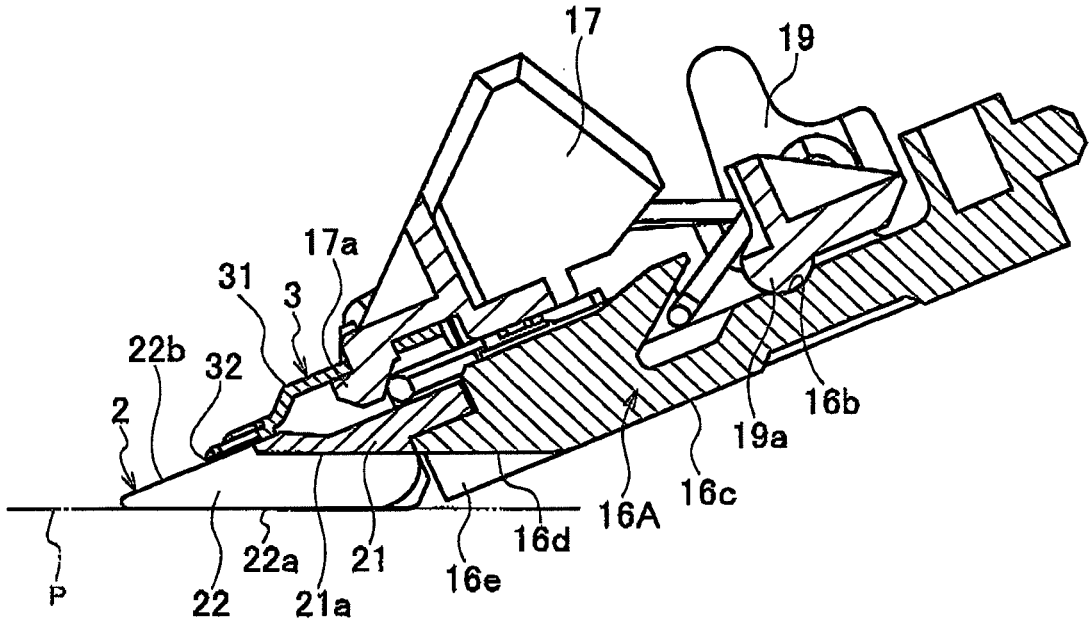
FIG. 7 is a cross-sectional view of a blade block of a hair-clipper according to a second embodiment of the present invention.
Figure 8:
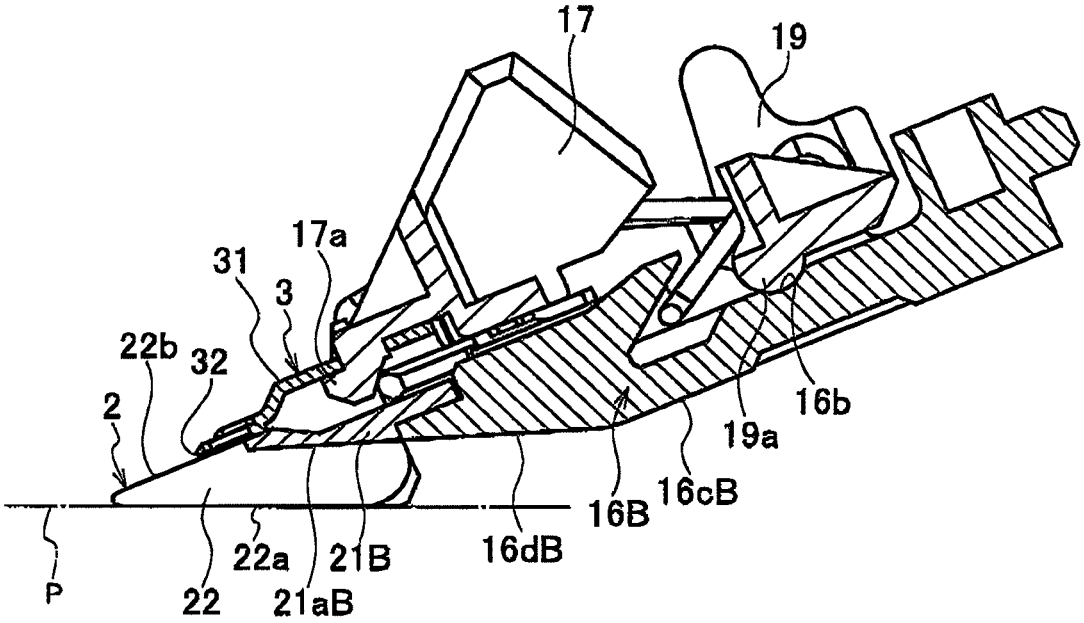
FIG. 8 is a cross-sectional view of a blade block of a hair-clipper according to a third embodiment of the present invention.

FIGS. 5 and 6 show a slide position of the movable blade 3 in a state where the cutting height of hair is set to the maximum.

The cutting height adjusting mechanism described above is only one example, and any known cutting height adjusting mechanisms may be used only if the movable blade 3 can be slid in the projecting direction Y with respect to the stationary blade 2 in accordance with a user's operation.

The comb projection 22 of the stationary blade 2 is provided at its lower surface with a skin-contact surface 22*a* that abuts against a skin. The comb projection 22 is also provided at its upper surface with a slide surface 22*b* with which the comb projection 32 of the movable blade 3 comes into slide contact.

The main body 21 of the stationary blade 2 is provided at its lower surface with an opposed surface 21*a* opposed to a plane P including a skin-contact surface 22*a*.

In the first embodiment, as shown in FIG. 6, a rear end of the comb projection 22 is extended to a rear portion of the opposed surface 21*a* in the projecting direction (Y direction).

The fixing plate 16 includes a bottom surface 16C and an inclined surface 16*d*. The inclined surface 16*d* is provided on a front portion of the fixing plate 16 in the projecting direction (Y direction) of the comb projections 22 and 32, and is inclined forward from a front end of the bottom surface 16C in the projecting direction (Y direction) of the comb projections 22 and 32. As shown in FIG. 6, the inclined surface 16*d* is also opposed to the plane P including the skin-contact surface 22*a*.

In the first embodiment, the opposed surface 21*a* of the main body 21 and the inclined surface 16*d* of the fixing plate 16 are substantially in parallel to the skin-contact surface 22*a*, and the opposed surface 21*a* and the inclined surface 16*d* are flush with each other.

As shown in FIG. 6, the fixing-plate flange 16*f* of a front end of the fixing plate 16 supports a main-body flange 21*f* at a rear end of the main body 21, wherein a surface opposite a supporting surface 16*sp* of the fixing-plate flange 16*f* provides the inclined surface 16*d* of the fixing plate 16.

In a state where the blade block 4 is placed such that the skin-contact surface 22*a* is below the blade block 4 and horizontal, the opposed surface 21*a* of the main body 21 and the inclined surface 16*d* of the fixing plate 16 are located at high positions than the position of the comb projection 32 of the movable blade 3 in a state where the cutting height of hair is set to the maximum.

That is, a distance (shortest distance) between the plane P including the skin-contact surface 22*a* and the opposed surface 21*a* of the main body 21, and a distance (shortest distance) between the plane P including the skin-contact surface 22*a* and the inclined surface 16*d* of the fixing plate 16 are equal to or longer than a distance between the movable blade 3 and the comb projection 32 in a state where the plane P including the skin-contact surface 22*a* and the cutting height of hair become maximum.

The opposed surface 21*a* and the inclined surface 16*d* may be at the same height as the position of the comb projection 32.

Figure 3:
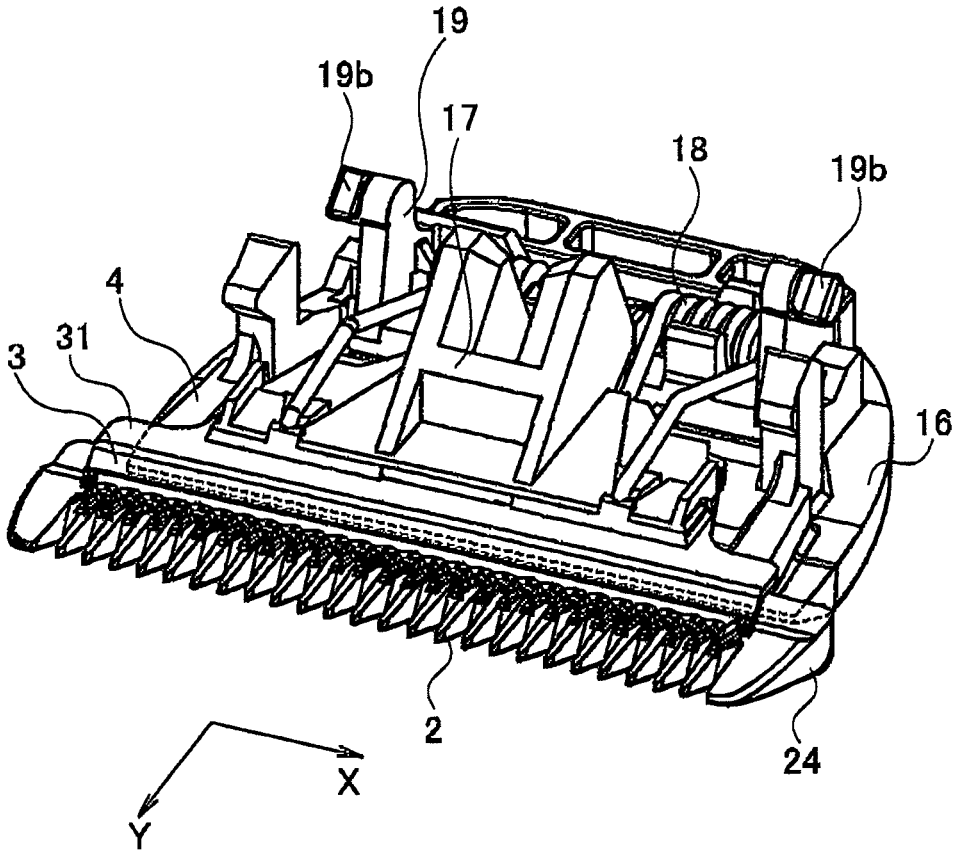
FIG. 3 is a perspective view of a blade block of the hair-clipper according to the first embodiment.
Figure 4:
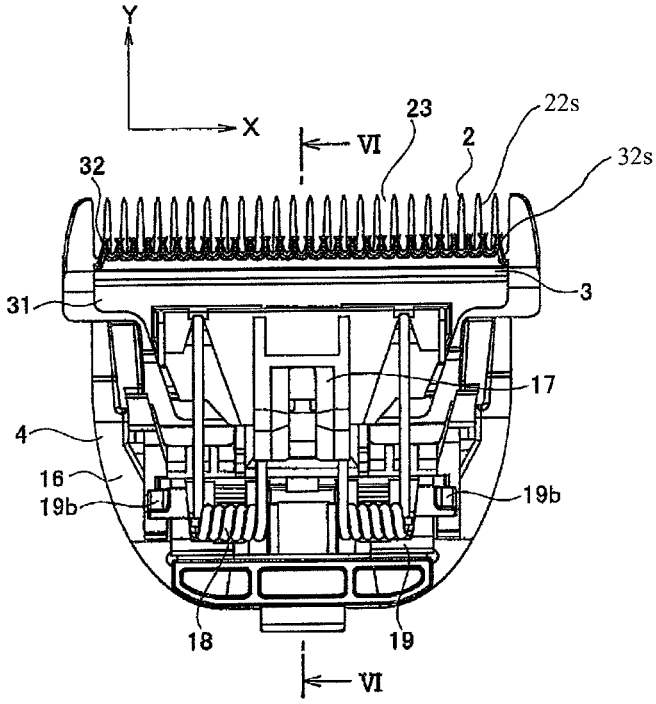
FIG. 4 is a plan view of the blade block of the hair-clipper according to the first embodiment.

In the first embodiment, smooth convex curve surfaces 24 (see FIGS. 3 and 4) having a large radius of curvature are formed on both side ends of the stationary blade 2 in a direction (X direction) in which the comb projections 22 are arranged. The convex curve surfaces 24 are formed on substantially the entire surface except a surface opposed to the movable blade 3.

When the blade block 4 is used in its inclined state such as a case that hair around an ear is cut, the convex curve surface 24 is formed into a smooth convex shape in which a thickness of the convex curve surface 24 is reduced toward its end in the arrangement direction (X direction) so that slip between the stationary blade 2 and a skin becomes excellent, and roots to blade tip ends of the comb projections 22 and 32 in the projecting direction (Y direction) are continuously formed.

According to the first embodiment, the blade block 4 is placed such that the skin-contact surface 22*a* is below the blade block 4 and is oriented horizontally, and the opposed surface 21*a* of the main body 21 and the inclined surface 16*d* of the fixing plate 16 are located above the position of the comb projection 32 of the movable blade 3 in a state where the cutting height of hair is set excessively high. Thus, it is possible to prevent hair that is cut when the hair-clipper is moved forward while bringing the skin-contact surface 22*a* into abutment against a skin from abutting against the opposed surface 21*a* and the inclined surface 16*d*. That is, since the cut hair is prevented from falling forward, it is possible to prevent cut before it is cut from being pushed forward, and the cutting height of hair can be more uniform.

As a result, it is unnecessary to bring the hair-clipper along the same orbit many times to obtain predetermined length of hair at the time of hair cutting and thus, the hair cutting time can be shortened. Further, since times of cutting hair by one cutting operation can be reduced, the lifetime of the blade can be increased as compared with a normal hair-clipper.

Further, in the first embodiment, the opposed surface 21*a* of the main body 21 and the inclined surface 16*d* of the fixing plate 16 are located higher than the position of the comb projection 32 of the movable blade 3 in a state where the hair cutting height becomes the maximum. Therefore, it is possible to more equalize the hair cutting height in the hair cutting height in all adjustable range.

According to the first embodiment, the opposed surface 21*a* of the main body 21 of the stationary blade 2 is formed into a plane that is substantially in parallel to the plane P including the skin-contact surface 22*a*. Therefore, the structure of the main body 21 can be simplified, and the main body 21 can be machined easily. As a result, the machining amount of the stationary blade 2 can be reduced and cost thereof can be reduced.

According to the first embodiment, since the rear end of the comb projection 22 is extended to the rear portion of the opposed surface 21*a* in the projecting direction (Y direction), the rear portion of the comb projection 22 also functions as the comb, and a direction of hair after it is cut can be put in order.

As shown in FIG. 6, a shortest distance d1 between the opposed surface 21*a* and the plane P including the skin-contact surface 22*a* is equal to or greater than a distance d2 between the plane P including the skin-contact surface 22*a* and the comb projection 32 of the movable blade 3.

Second Embodiment

A hair-clipper according to a second embodiment of the present invention has the same constituent elements as those of the hair-clipper according to the first embodiment. Therefore, these constituent elements are designated with like reference numerals, and redundant explanations thereof will be omitted.

The hair-clipper according to the second embodiment is different from the hair-clipper according to the first embodiment in that comb projections 22 of the stationary blade 2 correspond to the inclined surface 16*d* of a fixing plate 16A in terms of positions, and a rib 16*e* formed along the extending direction of the comb projection 22. Other structures of the second embodiment are basically the same as those of the first embodiment.

The same effects as those of the first embodiment can be also achieved by the second embodiment.

Further, according to the second embodiment, the inclined surface 16*d* of the fixing plate 16A is provided with a rib 16*e* that corresponds to the comb projection 22 in terms of position and that is formed in the extending direction of the comb projection 22. Hair after it is cut is put in order also by the rib 16*e*. That is, the direction of the cut hair can be put in order more excellently.

Third Embodiment

A hair-clipper according to a third embodiment of the present invention has the same constituent elements as those of the hair-clipper according to the first embodiment. Therefore, these constituent elements are designated with like reference numerals, and redundant explanations thereof will be omitted.

The hair-clipper according to the third embodiment is different from that of the first embodiment in that an opposed surface 21*a*B formed on a lower surface of a main body 21B of the stationary blade 2, and an inclined surface 16*d*B formed in a front portion a bottom surface 16*c*B of a fixing plate 16B in the projecting direction (Y direction) are inclined rearward of the comb projections 22 and 32 in the projecting direction (Y direction) with respect to the plane P including the skin-contact surface 22*a*, and the opposed surface 21*a*B and the inclined surface 16*d*B are flush with each other. Other structures of the third embodiment are basically the same as those of the first embodiment.

A distance between a front end of the opposed surface 21*a*B in the projecting direction (Y direction) which is the shortest distance between the plane P including the skin-contact surface 22*a* and the opposed surface 21*a*B of the main body 21B and the plane P including the skin-contact surface 22*a* is equal to or greater than a distance between the plane P including the skin-contact surface 22*a* and the comb projection 32 of the movable blade 3 in a state where the cutting height of hair is set to the maximum.

The same effects as those of the first embodiment can be also achieved by the third embodiment.

Fourth Embodiment

A hair-clipper according to a fourth embodiment of the present invention has the same constituent elements as those of the hair-clipper according to the first embodiment. Therefore, these constituent elements are designated with like reference numerals, and redundant explanations thereof will be omitted.

The hair-clipper according to the fourth embodiment is different from that of the first embodiment in that an inclined surface 16*d*C formed on a front portion of the bottom surface 16*c*C of the fixing plate 16C in the projecting direction (Y direction) is located higher than a position of the opposed surface 21*a* of the main body 21 in a state where the blade block 4 is placed such that the skin-contact surface 22*a* is blow the blade block 4 and horizontally. Other structures of the fourth embodiment are basically the same as those of the first embodiment.

Figure 9:
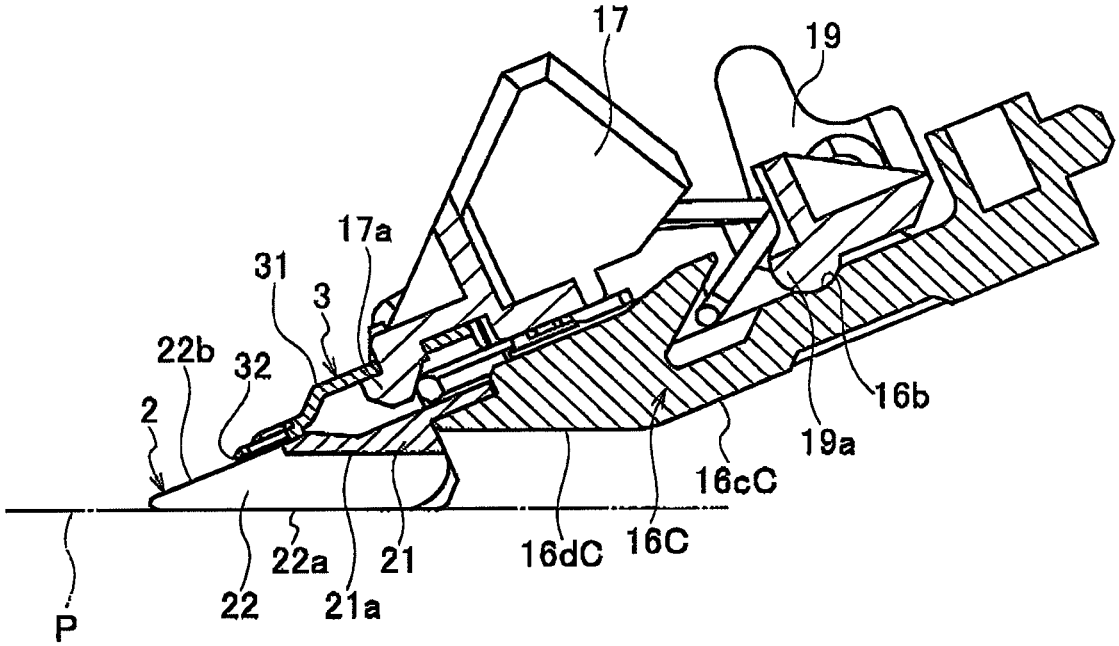
FIG. 9 is a cross-sectional view of a blade block of a hair-clipper according to a fourth embodiment of the present invention.

That is, in the fourth embodiment, the opposed surface 21*a* and the inclined surface 16*d*C are formed into steps as shown in FIG. 9.

The opposed surface 21*a* and the inclined surface 16*d*C are formed substantially in parallel to the plane P including the skin-contact surface 22*a*. A distance (shortest distance) between the plane P including the skin-contact surface 22*a* and the opposed surface 21*a* of the main body 21 is equal to or greater than a distance between the plane P including the skin-contact surface 22*a* and the comb projection 32 of the movable blade 3 in a state where the hair cutting height is set to maximum.

Although the opposed surface 21*a* and the inclined surface 16*d*C are substantially in parallel to the plane P including the skin-contact surface 22*a* in the fourth embodiment, the opposed surface 21*a* and the inclined surface 16*d*C may be inclined upward toward the rear portion of the comb projections 22 and 32 in the projecting direction (Y direction) with respect to the plane P including the skin-contact surface 22*a* as in the third embodiment.

The same effects as those of the first embodiment can be also achieved by the fourth embodiment.

While preferred embodiments of the hair-clipper according to the present invention have been explained above, the present invention is not limited thereto, and various other embodiments can be made without departing from the scope of the invention.

As described above, the first to fourth embodiments have exemplified the hair-clipper capable of adjusting the hair cutting height by sliding the movable blade to change the position of the movable blade with respect to the stationary blade. In the present invention, it is also possible to use a hair-clipper in which the position of a movable blade with respect to a stationary blade is not changed, i.e., it is possible to use a hair-clipper that does not have the cutting height adjusting function.

In the third and fourth embodiments, the inclined surface of the fixing plate can be provided with a rib.

In the first to fourth embodiments, the fixing plate is mounted on the stationary blade using the fixing plate that is a separate member from the stationary blade. Therefore, the blade block can be reduced in weight by mounting a resin fixing plate on a metal stationary blade. Further, because the ratio of a metal portion in the entire blade block can be reduced, it is possible to reduce the usage amount of metal and a machining amount of the metal portion and also possible to reduce the cost.

What is claimed is:

1. A hair-clipper comprising a stationary blade having a main body provided with a plurality of comb projections having cutting surfaces formed at sides thereof, and a movable blade that has a main body having a plurality of comb projections having cutting surfaces formed at sides thereof and that comes into slide contact with the stationary blade, in which the movable blade is reciprocated and slid in an arrangement direction of the comb projections with respect to the stationary blade to cut hair, wherein the comb projections of the stationary blade include a skin-contact surface which abuts against a skin, and a slide surface with which the comb projections of the movable blade come into slide contact, the main body of the stationary blade includes an opposed surface which is opposed to a plane including the skin-contact surface, and a shortest distance between the opposed surface and the plane including the skin-contact surface is equal to or greater than a distance between the plane including the skin-contact surface and the comb projection of the movable blade, the opposed surface of the main body and an inclined surface of a fixing plate are substantially in parallel to the plane including the skin-contact surface, and the opposed surface and the inclined surface are flush with each other, and a fixing-plate flange of a front end of the fixing plate supports a main-body flange at a rear end of the main body, wherein a surface opposite a supporting surface of the fixing-plate flange provides the inclined surface of the fixing plate.

2. The hair-clipper according to claim 1, wherein the fixing plate on which the main body of the stationary blade is mounted is provided on a rear portion of the comb projection of the main body of the stationary blade in the projecting direction, and the inclined surface being opposed to the plane including the skin-contact surface on the front portion of the fixing plate in the projecting direction of the comb projection.

3. The hair-clipper according to claim 1, further comprising:

the fixing-plate flange being positioned within a recess which is formed in a lower surface of the main body so as to define the main-body flange, and the fixing-plate flange, which provides a tip end at the front end of the fixing plate, is positioned within the recess such that the opposed surface and the inclined surface are flush with each other.

* * * * *